United States Patent [19]

Puthawala et al.

[11] 4,204,974

[45] May 27, 1980

[54] METHOD FOR REMOVING RADIOACTIVE PLASTIC WASTES AND APPARATUS THEREFOR

[75] Inventors: Anwer Puthawala; Lutz Hoffmann; Hermann Emmert, all of Erlangen; Werner Hild, Hochstetten; Hans-Erich John; Wolfgang Kluger, both of Leopoldshafen, all of Fed. Rep. of Germany

[73] Assignee: Kraftwerk Union Aktiengesellschaft, Mülheim. Fed. Rep. of Germany

[21] Appl. No.: 850,369

[22] Filed: Nov. 10, 1977

Related U.S. Application Data

[63] Continuation of Ser. No. 693,782, Jun. 8, 1976, abandoned.

[30] Foreign Application Priority Data

Jul. 15, 1975 [DE] Fed. Rep. of Germany ..... 2531584

[51] Int. Cl.[2] ..... G21F 9/08; G21F 9/34

[52] U.S. Cl. ..... 252/301.1 W; 106/235

[58] Field of Search ..... 252/301.1 W; 693/782; 106/235

[56] References Cited

U.S. PATENT DOCUMENTS

| | | | |
|---|---|---|---|
| 3,716,490 | 2/1973 | Van de Voorde | 252/301.1 W |
| 3,791,981 | 2/1974 | Calmon | 252/301.1 W |
| 4,008,171 | 2/1977 | Tiepel et al. | 252/301.1 W |

FOREIGN PATENT DOCUMENTS

| | | | |
|---|---|---|---|
| 2251246 | 5/1974 | Fed. Rep. of Germany | 252/301.1 W |
| 1520681 | 4/1968 | France | 252/301.1 W |

*Primary Examiner*—Benjamin R. Padgett
*Assistant Examiner*—Deborah L. Kyle
*Attorney, Agent, or Firm*—Herbert L. Lerner

[57] ABSTRACT

Method and apparatus for encapsulating radioactive plastic wastes, particularly radioactively contaminated ion exchange filter material containing water, in bituminous solidification substances, by drying the radioactive waste separate and apart from the bituminous substance, introducing regulated amounts of dry radioactive waste into the bituminous substance and kneading the mixture at a temperature of 120° C. or lower to encapsulate the dry radioactive waste by the mechanical action of the kneading, and pouring the kneaded, encapsulated radioactive plastic waste into a container. Undesired decomposition with discharge of pollutants into the atmosphere are avoided.

4 Claims, 2 Drawing Figures

METHOD FOR REMOVING RADIOACTIVE PLASTIC WASTES AND APPARATUS THEREFOR

This is a continuation of application Ser. No. 693,782, filed June 8, 1976 now abandoned.

BACKGROUND OF THE INVENTION

1. Field of the Invention

The invention relates to removing radioactive plastic wastes and more particularly, refers to new and improved method and apparatus for removing radioactively contaminated ion exchanger filter materials by embedding in a bituminous solidification substance.

2. Description of the Prior Art

Radioactive plastic wastes have heretofore been disposed of by adding the wet plastic waste to hot bituminous substances thereby simultaneously drying the waste and covering the waste with bitumen. The bitumen covered waste is filled into containers such as barrels, which serve for final storage.

The methods known up to now (cf. the German Published Non-Prosecuted Applications DT-OS Nos. 14 64 476, DT-OS No. 14 64 859, DT-OS No. 21 65 510 and the German Published Prosecuted Applications DT-AS No. 1 589 839 and DT-AS No. 1 614 071) largely operate at relatively high temperatures, of the order of 160° or higher. One important reason for this is to keep the bitumen as "thin" as possible, i.e. the bitumen should be non-viscous to thoroughly coat and encapsulate the wastes. In addition, one wants to perform a drying process with the bitumen in order to achieve a tight enclosure of the radioactive plastic wastes that are to be embeded. This tight enclosure is necessary because the danger of leaching in the event of an inrush of water into the storage place is to be avoided. High temperatures and the need for drying, however, are uneconomical, and may also have undesirable consequences for reasons of chemical reactions.

Simultaneous drying and encapsulating at higher temperatures as commonly practiced heretofore has the following disadvantages:

The resins were decomposed by chemical reaction and gases (e.g., amines) were liberated in the process.

These gases were an increased pollutant on the environment as they have a penetrating odor and are explosive.

As the product of resin and bitumen, produced at higher temperatures, would strongly foam due to the formation of gas, the safety of pouring was jeopardized.

The dosaging of moist resins was difficult because of clotting and was not operationally safe.

SUMMARY OF THE INVENTION

It is accordingly an object of the invention to provide an efficient method and apparatus for removing radioactive plastic wastes, which eliminates the heretoforementioned disadvantages.

With the foregoing and other objects in view, there is provided in accordance with the invention a method for removing radioactive plastic wastes, particularly radioactively contaminated ion exchange filter material admixed with water, by drying and encapsulating in bituminous solidification substances and pouring into a container, which includes subjecting the radioactive waste separate and apart from the bituminous substance to drying to produce a substantially dry radioactive waste, introducing regulated amounts of the dry radioactive waste into the bituminous substance, subjecting the mixture of dry radioactive waste and bituminous substance to kneading to effect encapsulation of the radioactive waste by the mechanical action of the kneading, maintaining the mixture at a temperature below 120° C. during the kneading, and discharging the kneaded, encapsulated radioactive plastic waste into a container.

Further there is provided in accordance with the invention apparatus for removing radioactive plastic wastes, particularly contaminated ion exchange filter material admixed with water, which includes a vertical collecting and drying vessel having an inlet for the introduction of radioactive waste, a source of hot drying gas, a hot gas inlet in the drying vessel for the introduction of the gas for passage in contact with radioactive waste, a gas outlet in the drying vessel for discharge of the gas after contact with the radioactive waste, a dry radioactive waste outlet at the bottom of the drying vessel for the discharge of dry radioactive waste, a dosage device connected to the radioactive waste outlet for regulating measured amounts of dry radioactive waste, a substantially vertical conduit connected at its upper end to the dosage device for receiving the measured amounts of dry radioactive waste and downward passage by gravity through the conduit, a horizontal kneader at a level below the drying vessel connected at its inlet end with the lower end of the conduit to receive the dry radioactive waste, a source of bitumious substance, a bitumen inlet at the inlet end of the kneader for the introduction of the bituminous material in admixture with the dry radioactive waste, power means for mechanically kneading the mixture to encapsulate the radioactive waste, heating means for heating the mixture during kneading, an outlet at the other end of the kneader for the discharge of encapsulated radioactive waste, and a container filling station adjacent the kneader discharge.

BRIEF DESCRIPTION OF THE DRAWING

Other features which are considered as characteristic for the invention are set forth in the appended claims.

Although the invention is illustrated and described herein as embodied in method for removing radioactive plastic wastes and apparatus therefor, it is nevertheless not intended to be limited to the details shown, since various modifications may be made therein without departing from the spirit of the invention and within the scope and range of equivalents of the claims.

The invention, however, together with additional objects and advantages thereof will be best understood from the following description when read in connection with the accompanying drawing.

Figure 1:
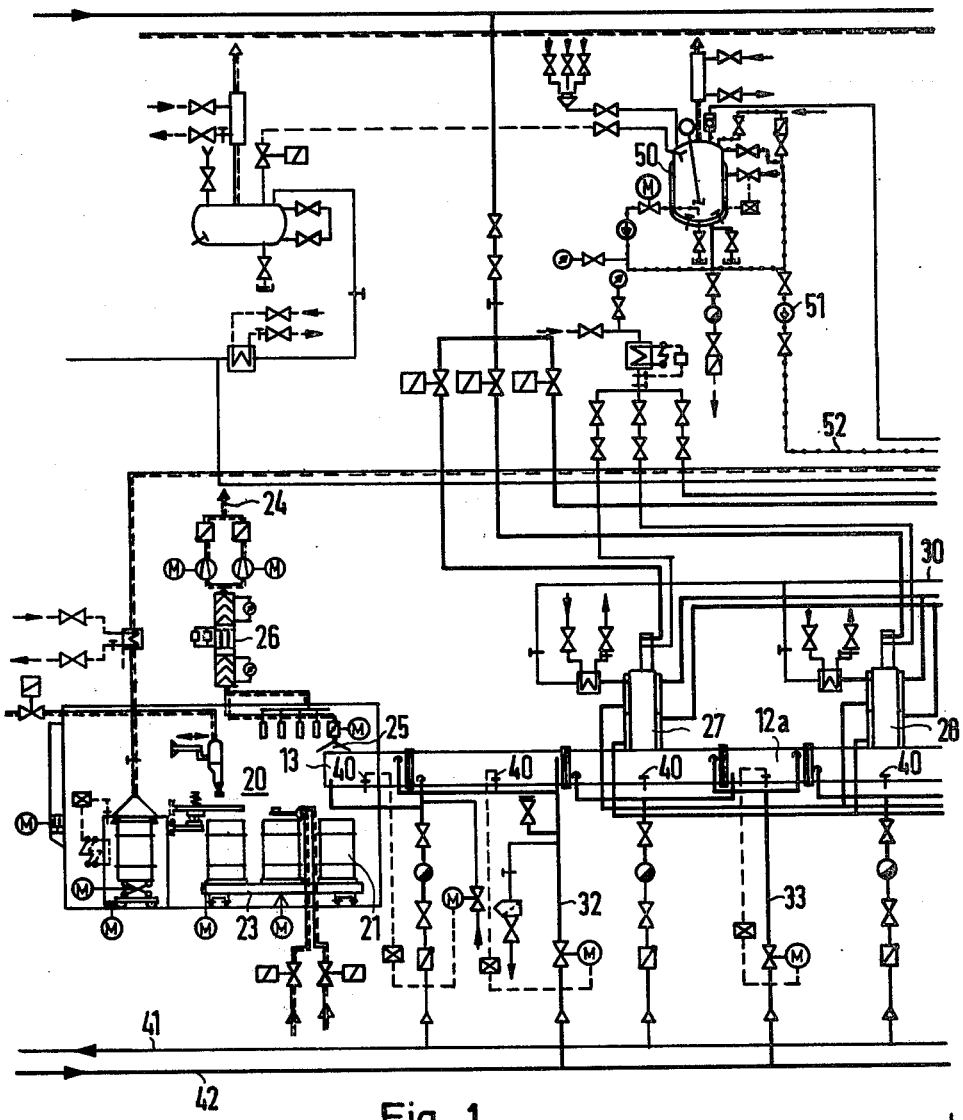
Figure 2:
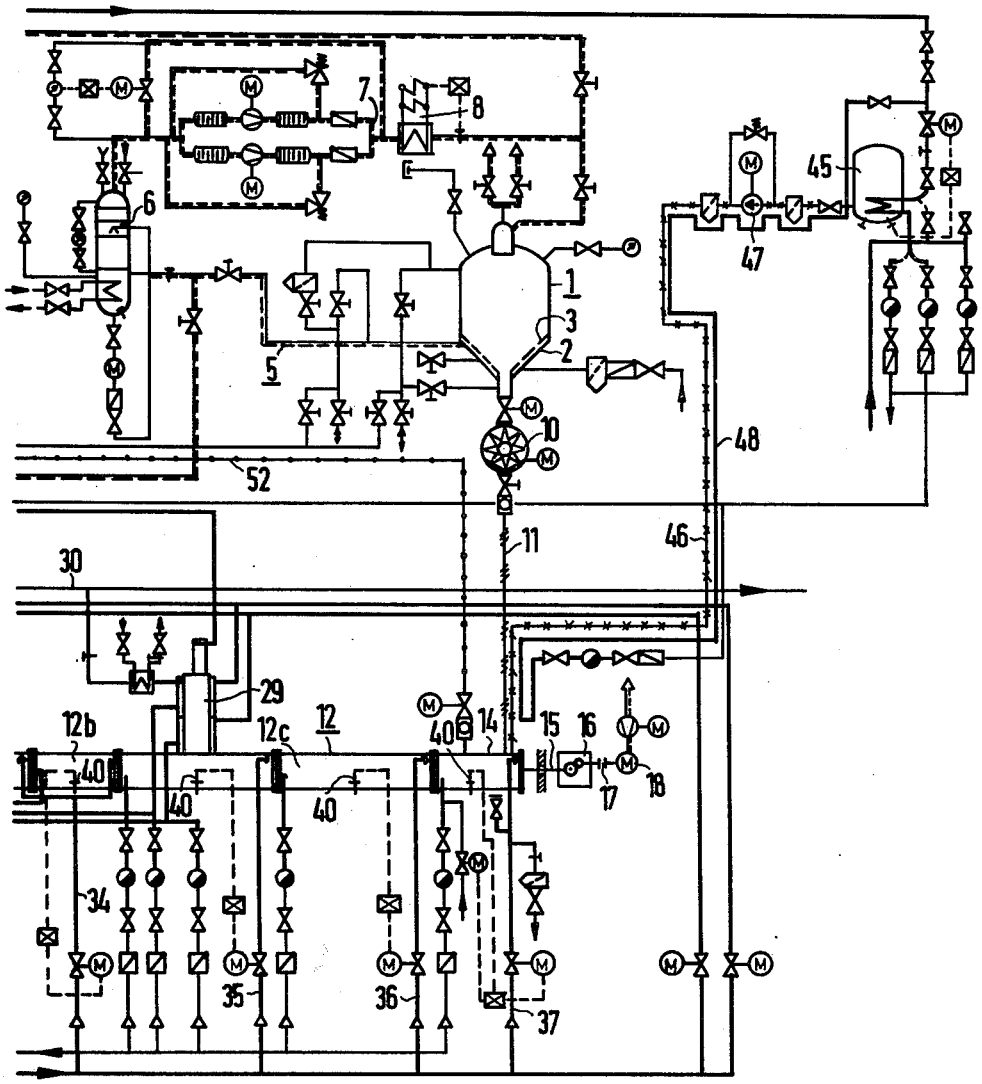

FIGS. 1 and 2 are the left and right sections of diagrammatic flow sheet of a plant shown as a piping diagram with the usual symbols and includes the facilities for removing radioactive plastic wastes in accordance with the invention, and also parts for the treatment of concentrates of a coolant treatment system for a pressurized-water power reactor.

DESCRIPTION OF THE PREFERRED EMBODIMENT

According to the invention, the plastic wastes are practically completely dried by hot air in a separate drying container. The dry plastic wastes are placed, via a dosaging device, in a kneading machine which can be charged with bitumen. The bitumen and plastic wastes are mixed at temperatures of 120° C. or less preferably 80° to 100° C., and filled into the container.

The drying of the plastic wastes is therefore performed at a single point. This point may advantageously be a drying chamber which serves at the same time as a collecting tank as the quantities of synthetic resin, particularly from ion exchange filters, which are produced in a nuclear power station, are relatively small. The drying process can be spread here also over an extended period to time, so that the energy consumption is low.

The flowable, dried plastic wastes can be placed in the kneading machine via a dosaging device at a convenient time. Such a kneading machine is conventional and usually already available in cooling-water treatment systems, for example, for the treatment of concentrate. Normally such available kneading machine is not in constant use and may be used also for removing the plastic wastes during the times it would be idle. However, a separate kneader may also be provided.

Processing bitumen and plastic wastes at temperatures of 120° C. or less is contrary to all processes presently practiced, as the temperatures have been up to now near 160° C. or above, to effect simultaneous drying and encapsulation. The lower processing temperature in accordance with the invention may in some circumstances necessitate larger forces for operating the kneader. This, however, is of secondary importance because the quantities to be processed are small. In any event, this consideration is of little or no significance when it is considered that the process of the invention can also treat more sensitive resins, which have a tendency of gassing with resultant foaming at temperatures of the magnitude commonly employed heretofore. Successful tests have demonstrated that the method of the present invention makes it possible to remove with a minimum of cost, radioactive plastic wastes in a desired, safe and environment-compatible manner.

The drying is preferably performed at temperatures of 60° to 80° C., although lower and higher temperatures from about 40° C. to in excess of 100° C. may be employed provided the drying is not unduly prolonged or the temperature so high as to cause material decomposition. The hot air serving for the drying may during operation entrain dust particles or gases or both and therefore can be conducted from the drying container into a gas scrubber or a filter for purification. The dust particles or gases, entrained by the air in the drying process, are extracted by a scrubbing liquid, which latter is purified later if necessary. The hot air may be recirculated in a closed circuit which includes, not only the gas scrubber and/or air blower, but also heat exchangers and optionally, driers for removing moisture from the air.

In one advantageous embodiment of the invention, flowable dried spherical resins, i.e., resins of spherical shape with diameters of 0.1 to 1 mm, are mixed with the bitumen in the raio 1:1. This mixture is discharged from the kneader at 110° C. It is sent directly into barrels serving for the final storage, e.g,. the standardized 200 l barrels, which are also serve for shipping. While the ratio of resin to bitumen may vary, good results are usually obtained in the range of one part resin to 0.7 to 2 parts bitumen by volume.

As already mentioned, the amount of technical means i.e. physical equipment, required by the invention is advantageously small. An important component is a tank which is preferably designed as a vented drying vessel. The tank is equipped with a dosaging device at its lower end. The dosaging device may be connected via a gravity line with the one end of a horizontal kneader. A barrel-filling station is located at the other end of the kneader. With this arrangement, the transport of the resin after the drying process to the kneader is accomplished practically entirely by gravity. Movement in the kneader is caused by the motion of the worm of the kneader, which is necessary for the mixing process. The resins are introduced into the drying tank as a sludge; suitable pumps are usually also already available in the plant for this purpose.

The dosaging device has the purpose to control the feeding into the kneader, so that the desired mixing ratio, e.g., the heretoforementioned ratio 1:1, is maintained with the required accuracy. A cell-wheel type of lock also commonly referred to as rotary feeder or star feeder can be used for this purpose, but other suitable dosaging dosaging devices may be employed.

Contaminated ion exchange resin for encapsulation are radioactive and contain appreciable amounts of water. Such resins are sensitive to heat and decompose at higher temperatures of the order of 150° C. or tend to chemically react with impurities or foreign bodies, with the result that noxious gases are liberated to the atmosphere polluting the surrounding air. The water in the contaminated resin makes it difficult to dispense measured dosages of resin because the water causes clotting of the resin particles into clumps and further there are variations in water content attached thereto. Thus, drying of the contaminated resin separate and apart from the bitumen overcomes these difficulties.

A previously mentioned bitumens were known for encapsulating contaminated plastic wastes and this purpose the moist waste was introduced into the bitumen heated to a relatively high temperature of about 160° C. or higher to "thin" i.e. reduce the normally solid bitumen to a low viscosity to enable ready coverage of the waste and simultaneously dry the waste. Unfortunately, the product of the resin and the bitumen produced at such higher temperatures tends to foam due to the formation of gas, thereby making pouring an unsafe operation. In the process of the present invention such high temperatures are avoided and the temperature of the bitumen admixed with the dry resin is maintained at a temperature not to exceed 120° C. The bitumen is heated to a temperature sufficient to permit the bitumen to be kneaded and encapsulate the resin, preferably a temperature of about 90° to 110° C. The bitumen at these low temperatures is appreciable more viscous than the "thin" bitumen at the higher temperature, and by itself would not satisfactorily encapsulate the resin. In accordance with the invention, mechanical action, as for example by kneading, is applied to the low temperature bitumen and this combination accomplishes excellent encapsulation of the resin without the danger of gas formation and foaming and with safety in pouring.

As a rule, it will be advantageous to provide the kneader with a multi-stage housing, the stages of which can be heated by steam in parallel. Control of the temperature in the kneader is obtained in fine steps, so that the thermal stress of the resins to be embedded can be kept as low as possible. Further, the temperature can be maintained as closely as possible at the maximum values permissible for the processing, and high temperature hot spots with a too low viscosity of the bitumen is avoided.

For a more detailed explanation of the invention, the following embodiment will be described by reference to the drawing, which is shown as a piping diagram with the usual symbols. This piping diagram includes, besides the facilities for removing radioactive plastics in accordance with the invention, also parts for the treatment of concentrates of a coolant treatment system for a pressurized-water power reactor. The reason for this is that the invention can advantageously be combined with the concentrate treatment system, as thereby the expense for the removal of radioactive plastics in accordance with the invention can be kept particularly low.

In the drawing, a tank which serves as the resin-collecting and drying vessel, is designated by numeral 1. The radioactive resin resulting from the flushing of ion exchange filters is collected in tank 1. The radioactive resin is transferred to the tank 1 by flowing it together with the flushing water into the tank. Inside the tank, one will recognize in the lower, conical part 2 a grating 3, which allows the tank to be ventilated in a hot air circuit 5. The hot-air loop includes a gas scrubber 6 with a condenser, a blower 7 arranged in duplicate with moisture separators connected in series and a heat exchanger 8.

Below the drying tank 1 is connected via shut-off valves a cell-wheel type lock 10, which leads into a vertical gravity line 11. The gravity line 11 leads to a kneader 12 having three stages **12*a*, 12*b*, 12*c*. The kneader 12 is arranged horizontally, as is evident from the figure. One end 14 of kneader 12 serves as the input for both the dry resin and bitumen. There, the drive shaft 15 for actuating the worm, not shown, of the kneader 12, is also disposed. The kneader shaft 15 is driven via a transmission 16 and by a motor 18**.

At the other end 13 of the kneader 12, a filling station 20 is provided. One will recognize barrels 21, which are transported on a carriage 23. With the filling station is associated a suction system 25, which leads via exhaust-air filters 26, into a line 24 opening into a stack.

Gas domes 27, 28 and 29, which are of the same design, are associated with the three stages of the kneader 12. The gas domes allow the removal of the gases and vapors produced in the kneading process via the lines 30, which may likewise lead to filters and into the stack.

Steam lines are attached to the kneader 12 which are drawn as solid lines and which allow fine local control of the temperature in the kneader in six parallel legs 32, 33, 34, 35, 36 and 37, so that the temperature does not exceed 110° C. at any point under any operating conditions. The associated thermostats 40 control, via suitable valves, either the supply of steam or the discharge of the condensate. The condensate discharge lines lead to a common outlet 41, while the inlet for the steam is designated by numeral 42.

The bitumen required for embedment comes from a bitumen tank 45, which like the line 46 leading to the kneader 12, including the bitumen pump 47 arranged therein, can be heated by means of a steam line 48. The bitumen pump 47 provides at the same time the necessary dosaging of the bitumen, so that the desired mixing ratio of 1:1 is maintained. In the bitumen tank 45 and line 46, higher temperatures of, say, 140° C. can be maintained so that there is advantageous viscosity and optionally, the resin which was cooled down in the cell-wheel type lock 10 and in the gravity line 11, is heated to the desired temperature of 110° C. immediately at the start of the mixing.

A tank 50 serves as the intermediate tank for the concentrate. It accepts the concentrate of radioactive wastes which are produced in the cooling water treatment, and which is obtained, for example, in an evaporation process. From the tank 50, the concentrate can be taken via a dosaging pump 51 and a line 52 to the inlet 14 of the kneader 12, so that the embedment of the radioactive plastics according to the invention requires no separate kneader.

There are claimed:

1. In a method for removing radioactive plastic wastes, consisting essentially of radioactively contaminated ion exchange filter material admixed with water, by drying and encapsulating in bituminous solidification substances and pouring into a container, the improvement which comprises subjecting the previously untreated radioactive waste separate and apart from siad bituminous substance to drying at temperatures of 60° to 80° C. to produce a flowably dry radioactive waste without decomposition of the waste, introducing regulated amounts of said dry radioactive waste into said bituminous substance at a temperature sufficient to permit the bitumen to be kneaded and encapsulate the resin but insufficient by itself to render the bitumen fluid enough to satisfactorily encapsulate the resin without agitation, subjecting said mixture of dry radioactive waste and bituminous substance to kneading to effect encapsulation of said radioactive waste by the mechanical action of said kneading, maintaining said mixture at a temperature below 120° C. during said kneading to prevent gas formation and foaming of the mixture, and discharging the kneaded, encapsulated, radioactive plastic waste into a container.

2. Method according to claim 3, wherein said drying is effected by passing hot air in direct contact with said radioactive waste.

3. Method according to claim 2 wherein said hot air after contact with said radioactive waste is passed through a purification zone for removal of particles entrained by contact with said radioactive waste, heated by indirect heat exchange, and returned in a closed circuit to effect further drying of said radioactive waste.

4. Method according to claim 1 wherein said radioactive waste is radioactively contaminated spherical resins and said flowably dried spherical resins are mixed with the bituminous substance in the ratio of about 1:1 and the mixture after kneading discharged at a temperature of about 100° to 115° C.

* * * * *